United States Patent [19]

Graube

[11] 3,963,490

[45] June 15, 1976

[54] DYE SENSITIZED DICHROMATED GELATIN HOLOGRAPHIC MATERIAL

[75] Inventor: Andrejs Graube, Canoga Park, Calif.

[73] Assignee: The United States of America as represented by the Secretary of the Air Force, Washington, D.C.

[22] Filed: Sept. 25, 1974

[21] Appl. No.: 509,201

[52] U.S. Cl. ..... 96/27 H; 96/93

[51] Int. Cl.[2] ..... G03C 1/10; G03C 1/66

[58] Field of Search ..... 96/93, 49, 27 H

[56] References Cited

UNITED STATES PATENTS

| | | | |
|---|---|---|---|
| 3,074,794 | 1/1963 | Oster et al. | 96/93 X |
| 3,260,599 | 6/1966 | Lokken | 96/91 X |
| 3,567,444 | 3/1971 | Shankoff | 96/93 X |

FOREIGN PATENTS OR APPLICATIONS

| | | |
|---|---|---|
| 2,322,275 | 11/1973 | Germany |
| 763,388 | 5/1952 | Germany |

OTHER PUBLICATIONS

Kosar, Light-Sensitive Systems, 8/27/65, pp. 71–74.

*Primary Examiner*—David Klein
*Assistant Examiner*—Louis Falasco
*Attorney, Agent, or Firm*—Joseph E. Rusz; William J. O'Brien

[57] ABSTRACT

A technique for increasing the spectral sensitivity of a dichromated gelatin holographic material by adding a spectrally sensitive dye to the holographic material.

1 Claim, No Drawings

DYE SENSITIZED DICHROMATED GELATIN HOLOGRAPHIC MATERIAL

STATEMENT OF GOVERNMENT INTEREST

The invention described herein may be manufactured and used by or for the Government for governmental purpose without the payment of any royalty thereon.

BACKGROUND OF THE INVENTION

This invention relates to a method for preparing a dye sensitized dichromated gelatin hologram and to the hologram prepared therefrom.

One of the more important discoveries emerging from the development of the laser is a recording technique known as holography. In essence, this technique records, and later reconstructs the amplitude and phase distributions of a coherent wave disturbance.

The technique is widely used as a method of optical image formation, and in addition has been successfully used with acoustical and radio waves.

The fundamentals of holography are known; and the technique, generally, is accomplished by recording the pattern of interference between the unknown "object" wave of interest and a known "reference" wave. In general, the object wave is generated by illuminating the (possibly three-dimensional) subject of concern with a highly coherent beam of light, such as supplied by a laser source. The waves reflected from the object strike a light-sensitive recording medium, such as photographic film or plate. Simultaneously a portion of the light is allowed to bypass the object, and is sent directly to the recording plane, typically by means of a mirror placed next to the object. Thus incident on the recording medium is the sum of the light from the object and a mutually coherent "reference" wave.

While all light-sensitive recording media respond only to light intensity (that is, power), nonetheless in the pattern of interference between reference and object waves there is preserved a complete record of both the amplitude and the phase distributions of the object wave. Amplitude information is preserved as a modulation of the depth of the interference fringes, while phase information is preserved as variations of the position of the fringes.

The photographic recording obtained is known as a hologram (meaning a "total recording"); this record generally bears no resemblance to the original object, but rather is a collection of many fine fringes which appear in rather irregular patterns. Nonetheless, when this photographic transparency is illuminated by coherent light, one of the transmitted wave components is an exact duplication of the original object wave. This wave component therefore appears to originate from the object (although the object has long since been removed) and accordingly generates a virtual image of it, which appears to an observer to exist in three-dimensional space behind the transparency. The image is truly three-dimensional in the sense that the observer must refocus his eyes to examine foreground and background, and indeed can "look behind" objects in the foreground simply by moving his head laterally.

Also generated are several other wave components, some of which are extraneous, but one of which focuses of its own accord to form a real image in space between the observer and the transparency. This image is generally of less utility than the virtual image because its parallax relations are opposite to those of the original object.

Because of the emerging importance of holograms, a considerable research effort has been directed toward the mechanics of recording the image and the media utilized to effect and display the image. A typical media for recording the hologram is composed of an aqueous gelatin system such as pyridine-di-chromate or ammonium dichromate. The efficacy of the dichromated gelatin system is based upon the difference in swelling between the exposed and unexposed gelatin. The difference in swelling is induced photochemically by cross-linking of the gelatin through photolytic decomposition products of the dichromate sensitizer which renders the gelatin insoluble to a degree dependent on total exposure. The resultant image is developed by removal of gelatin not previously cross-linked as well as by the shrinkage and splitting or cracking of the gelatin.

Although dichromated gelatin systems have been proven to be satisfactory for use as a holographic material, such systems suffer certain drawbacks because their spectral sensitivity is limited to wavelengths of less than 520 nanometers. In an attempt to overcome this problem, however, it has been discovered that the addition of a dye sensitization material extends spectral sensitivity of the dichromated gelatin system to an unexpected degree.

SUMMARY OF THE INVENTION

In accordance with the broad concept of this invention, it has been found that the addition of a dye to a dichromated gelatin system extends the spectral sensitivity of the system throughout the visible and near infrared spectral regions. The dyes found to be effective as the sensitizer additive are those from the thiazine and triphenylmethane chemical families. The dye sensitized dichromated gelatin of this invention is capable of producing permanent, thick, phase holograms of high diffraction efficiency, good optical quality, and large refractive index change in the red spectral region.

Accordingly, the primary object of this invention is to provide a novel dichromated gelatin system for use as a holographic material.

Another object of this invention is to provide a dichromated gelatin system that is characterized by an increased spectral sensitivity throughout the visible and near infrared spectral regions.

Still another object of this invention is to provide a dichromated gelatin system that is rendered sensitive to red light through the addition of a dye sensitizing agent.

A further object of this invention is to provide a method for producing a holographic image by using a dye sensitized dichromated gelatin.

DESCRIPTION OF THE PREFERRED EMBODIMENT

Pursuant to the above-defined objects of this invention, it has been discovered that the spectral sensitivity of a dichromated gelatin hologram can be extended throughout the visible and near infrared spectral regions by the addition of a dye sensitizing agent to the dichromated gelatin material utilized in forming the hologram. Heretofore, non dye sensitized dichromated gelatin and silver halide-dichromate emulsions have been utilized in recording holographic images or holograms. However, the spectral sensitivity of such halograms has been limited to wavelength of less than about 520 nanometers. On the other hand, the dye sensitization technique of this invention has extended the spectral sensitivity of the halogram throughout the visible and near infrared spectral regions. In particular, dyes from the thiazine and triphenylmethane chemical families have been found to render dichromated gelatin sensitive to red light. Both transmission and reflection, thick phase halograms have been recorded using the dye sensitized dichromated gelatin of this invention. Resolution is greater than 4000 cycles/mm and light induced refractive index changes greater than 0.02 have been observed.

In general, the present invention encompasses the concept of adding a spectrally sensitive dye to gelatin and ammonium dichromate. The addition of the dye can be accomplished in a variety of ways. For example, a dry gelatin film can be soaked in a solution of dye and ammonium dichromate; or alternatively, a film can be cast from a dye and gelatin solution and then dried and soaked in ammonium dichromate solution. A third method involves casting a film from a dye, ammonium dichromate and gelatin solution; while a fourth method involves casting a film from ammonium dichromate and gelatin, drying the film and then soaking the film in a dye solution.

With the foregoing general discussion in mind, there is presented herein a detailed example which illustrates to those skilled in the art the specifics of this invention. It is to be understood, however, that the example is illustrative only and is not intended to be limiting in any way.

EXAMPLE I

This example describes the preparation of a holographic recording film and the technique for increasing its spectral sensitivity. First, a solution is prepared by adding 7 grams of gelatin and 0.035 grams of ammonium dichromate to 93 ml of water. This solution is then cast on a glass substrate and dried at room temperature to form a dry film with a thickness of from about 6 to 25 micrometers. The film is then exposed to room light for four hours to preharden the film. Then, in the dark, the film is sensitized by immersing it for ten minutes into a solution containing $5X10^{-4}M$ acid fast violet dye (Color Index No. 42561) and 0.4 M $(NH_4)_2Cr_2O_7$. The film is then dried in the dark for two hours at room temperature and 20 to 80 percent relative humidity.

Next, the dye sensitized film is exposed to the interfering beams of a He-Ne laser to give a 200 $mJ/cm^2$ average exposure. Development of the film is effected by dipping the film for 5 minutes into water held at room temperature with mild agitation. The film is then dipped in isopropanol for 2 minutes at room temperature with vigorous agitation. Drying was accomplished in a dry nitrogen atmosphere (relative humidity less than 3 percent) for 15 minutes.

The resulting phase hologram contained a permanent fringe pattern from the two interfering laser beams. It was characterized by a high diffraction efficiency, good optical quality, and a large refractive index change in the red spectral region.

While the present invention has been described in detail with reference to a specific embodiment thereof, it is to be understood that various modifications and alterations may be resorted to without departing from the spirit and scope of the invention. The invention, therefore, is not intended to be limited by the illustrative example, but only by the appended claims.

What is claimed is:

1. A method for increasing the spectral sensitivity of a dichromated gelatin-based hologram which comprises the steps of a. preparing an aqueous solution of gelatin and ammonium dichromate;

b. casting said solution onto a glass substrate to form a substrate having a radiation sensitive dichromated gelatin layer;

c. exposing said layered substrate to room light to preharden said gelatin layer;

d. sensitizing said gelatin layer by immersing said layered substrate into a solution containing (1) a spectrally sensitive acid fast violet dye selected from the group consisting of the thiazine and triphenylmethane dyes and, (2) ammonium dichromate;

e. drying said sensitized gelatin layer and then exposing said dried gelatin layer to the interfering beams of a He-Ne laser to give a 200 $mJ/cm^2$ average exposure; and f. developing said exposed gelatin layer to form a phase hologram containing a permanent fringe pattern from the said interfering laser beams.

* * * * *